US006167688B1

(12) United States Patent
Umeoka

(10) Patent No.: US 6,167,688 B1
(45) Date of Patent: Jan. 2, 2001

(54) INDIVIDUAL-SPINDLE-DRIVE TYPE MULTIPLE TWISTER

(75) Inventor: Toshinari Umeoka, Uji (JP)

(73) Assignee: Murata Kikai Kabushiki Kaisha, Kyoto (JP)

( * ) Notice: Under 35 U.S.C. 154(b), the term of this patent shall be extended for 0 days.

(21) Appl. No.: 09/301,017

(22) Filed: Apr. 28, 1999

(30) Foreign Application Priority Data

Aug. 13, 1998 (JP) ..... 10-228877
Aug. 13, 1998 (JP) ..... 10-228953

(51) Int. Cl.[7] ..... D01H 13/18

(52) U.S. Cl. ..... 57/88; 57/264; 57/100; 57/93; 57/94

(58) Field of Search ..... 57/88, 100, 78, 57/93, 94, 264, 80, 81, 97, 61

(56) References Cited

U.S. PATENT DOCUMENTS 3,823,540 * 7/1974 Mandl ..... 57/88
4,817,371 * 4/1989 Wolf ..... 57/100
4,947,634 * 8/1990 Stuwald ..... 57/100
5,572,859 * 11/1996 Derichs et al. ..... 57/100
5,906,092 * 5/1999 Hattori ..... 57/100

FOREIGN PATENT DOCUMENTS 64-68527 3/1989 (JP) .

* cited by examiner

*Primary Examiner*—John J. Calvert
*Assistant Examiner*—Mary K. Fiore
(74) *Attorney, Agent, or Firm*—Armstrong,Westerman, Hattori, McLeland & Naughton

(57) ABSTRACT

To provide an individual-spindle-drive type multiple twister that enables the position of a spindle that has stopped due to a malfunction to be promptly identified, thereby making it possible to drive and stop each spindle easily. An individual-spindle-drive type multiple twister M comprising a large number of twisting units installed in a line, each of which rotates a spindle so as to twist yarn Y1 released from a supply package P, and each of the spindles having a spindle drive source 8, wherein a switching means 23 corresponding to the spindle drive source 8 for each spindle is provided at the same or approximately the same height relative to a machine body in order to drive and stop the spindle drive source for each spindle.

10 Claims, 9 Drawing Sheets

INDIVIDUAL-SPINDLE-DRIVE TYPE MULTIPLE TWISTER

FIELD OF THE INVENTION

The present invention relates to an individual-spindle-drive type multiple twister comprising a larger number of twisting units installed in a line, and a spindle drive source provided for each spindle, and in particular, to an individual-spindle-drive type multiple twister that drives and stops the spindle drive source for each spindle.

BACKGROUND OF THE INVENTION

First, the structure of an individual-spindle-drive type multiple twister will be described with reference to FIG. 5. FIG. 5 shows a specific configuration of a single twisting unit TU in an individual-spindle-drive type multiple twister.

In a multiple twister, 80 to 304 twisting units are normally arranged in a line. The twisting unit TU for a single spindle unit comprises a spindle apparatus 1 and a winding apparatus 2. The spindle apparatus 1 has a stationary disc (not shown in the drawing) and a rotating disc 4 fixed to a spindle shaft 3. A yarn Y1 is unwound from a supply package P placed on the stationary disc that maintains its stationary state by means of magnetic attraction, and then enters a tension apparatus 5, in which it is subjected to a predetermined tension, and the rotating disc 4 located below the stationary disc then rotates at a high speed to move the yarn Y1 to a balloon guide 7 located above. The yarn Y1 is twisted twice, that is, it is once between the tension apparatus 5 and the rotating disc 4, and once between the rotating disc 4 and the balloon guide 7 to provide a twisted yarn Y2 that has been subjected to double twist. In the embodiment shown in FIG. 5, each spindle constitutes an individual-spindle-drive type twisting unit TU comprising a spindle drive source 8.

On the other hand, the winding apparatus 2 winds up the twisted yarn Y2 onto a winding package 9. The twisted yarn Y2 reaches a traverse guide 13 via guide rollers 10 and 11, and a feed roller 12. The twisted yarn Y2 is traversed by the traverse guide 13, and wound around the winding package 9 that is supported on a cradle arm 14, and contacts a contact roller 15 and rotes.

The count of twist per 1 meter in a double twister of this kind is expressed by the following equation.

$$\text{Count of twist}=[\text{rotation speed (rpm) of the rotating disc}\times 2]/\text{yarn speed (meter/minute)}$$

The yarn speed in the above equation depends on the winding speed of the winding apparatus 2. In addition, the rotation speed of the rotating disc depends on the rotation speed of the spindle shaft 3 of the spindle apparatus 1. To obtain a specified count of twist, the drive source 8 for the spindle apparatus 1 synchronizes with a drive source 16 for the winding apparatus 2.

The above single twisting unit TU may use a filament yarn supply package FP as shown in FIG. 2 or a spun yarn supply package SP as shown in FIG. 4.

On the other hand, as individual-spindle-drive type multiple twisters M each comprising a combination of twisting units TU, a two-stage type twister MA that is configured to have the twisting units TU having filament yarn supply packages FP disposed in upper and lower stages on both surfaces of a machine body, as shown in FIGS. 2 and 3, and a one-stage type twister MB that is configured to have the twisting units TU having the yarn supply packages disposed in one stage on both surfaces of the machine body, as shown in FIG. 4 are known.

In the individual-spindle-drive type multiple twister M configured as described above, since a large number of twisting units TU are installed in a line and a plurality of TU is installed in a line across working passages WP for operators, the operators cannot monitor the operating conditions longitudinally from the front (the direction from the sheet of FIG. 2 toward the reader) of the machine body at a distance. It is an object of the present invention to provide an individual-spindle-drive type multiple twister M that enables each spindle to be easily driven and stopped, and that enables the operator to promptly find, from a working passage provided along the machine body, the position of a spindle that is stopped due to a malfunction and take steps to correct the problem.

SUMMARY OF THE INVENTION

To achieve this object, the present invention provides an individual-spindle-drive type multiple twister comprising a large number of twisting units installed in a line to rotate a spindle to twist yarn unwound from a supply package, each of the spindles having a spindle drive source, wherein:

a switching means corresponding to the spindle drive source for each spindle is provided to drive and stop the spindle drive source for each spindle.

Furthermore, the present invention provides an individual-spindle-drive type multiple twister wherein all the switching means for each spindle corresponding to the large number of twisting units installed in a line are mounted on a switch mounting rail having a switch mounting surface, and are arranged at the same or approximately the same height relative to a machine body.

In addition, the present invention provides an individual-spindle-drive type multiple twister wherein the twisting units are arranged in a plurality of upper and lower stages, wherein a switch mounting rail commonly used for the upper and lower stages is provided along the machine body, and wherein switching means for the upper and lower stages are provided close to one another on the switch mounting rail.

Furthermore, the present invention provides an individual-spindle-drive type multiple twister wherein the switch mounting rail is mounted on the machine body via bracket members, and wherein a wiring terminal block is provided on the bracket member.

Moreover, the present invention provides an individual-spindle-drive type multiple twister wherein the switch mounting surface of the switch mounting rail inclines toward the machine body.

The present invention also provides an individual-spindle-drive type multiple twister wherein the switching means for each spindle protrudes from the switch mounting surface of the switch mounting rail.

In addition, the present invention provides an individual-spindle-drive type multiple twister wherein the switching means for each spindle is located rearward from the front end of the machine body.

Finally, the present invention provides an individual-spindle-drive type multiple twister wherein the switching means for each spindle includes a lighting means that lights while the twisting unit is stopped.

BRIEF DESCRIPTION OF THE DRAWING

FIG. 1 shows embodiments of an individual-spindle-drive type multiple twister according to the present invention wherein a switching means are mounted in different patterns of location.

FIG. 7 shows an example of the configuration of a conventional simultaneous drive type multiple twister.

DETAILED DESCRIPTION OF THE PREFERRED EMBODIMENTS

Figure 1A:
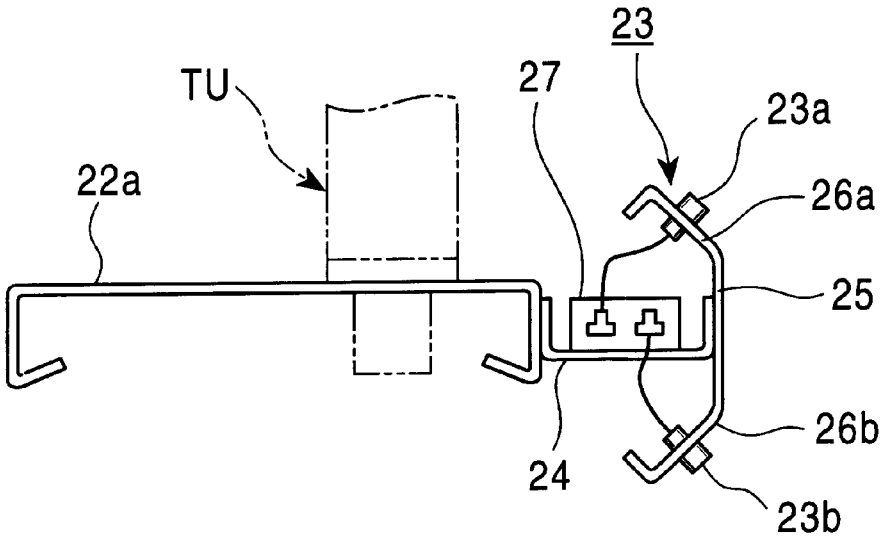
FIG. 1A is a schematic side view showing a first embodiment.

An individual-spindle-drive type multiple twister according to the present invention will be described below in detail based on the specific examples shown in the drawings.

Figure 1B:
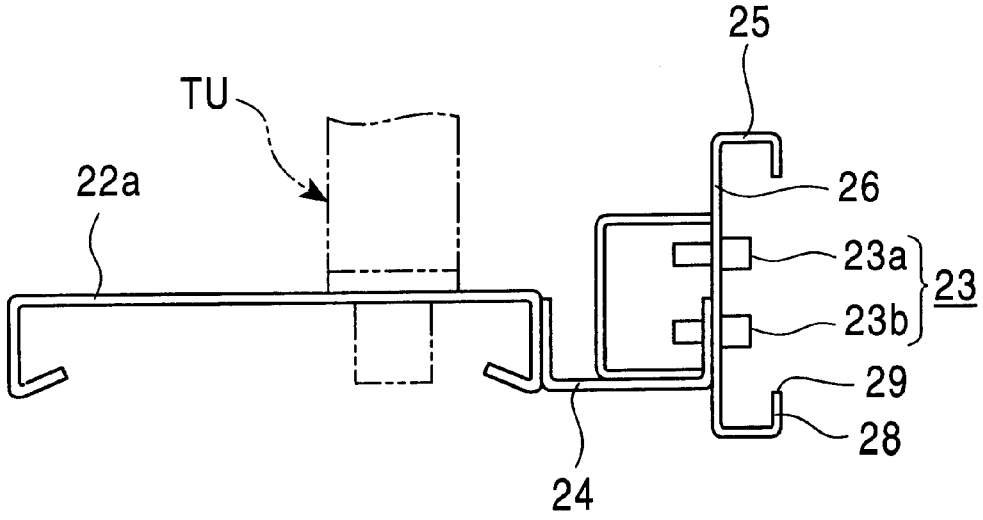
FIG. 1B is a schematic side view showing a second embodiment.

FIG. 1 shows embodiments of an individual-spindle-drive type multiple twister according to the present invention having different mounting aspects for a switching means, and FIG. 1A is a schematic side view showing a first embodiment, and FIG. 1B is a schematic side view showing a second embodiment.

Figure 2:
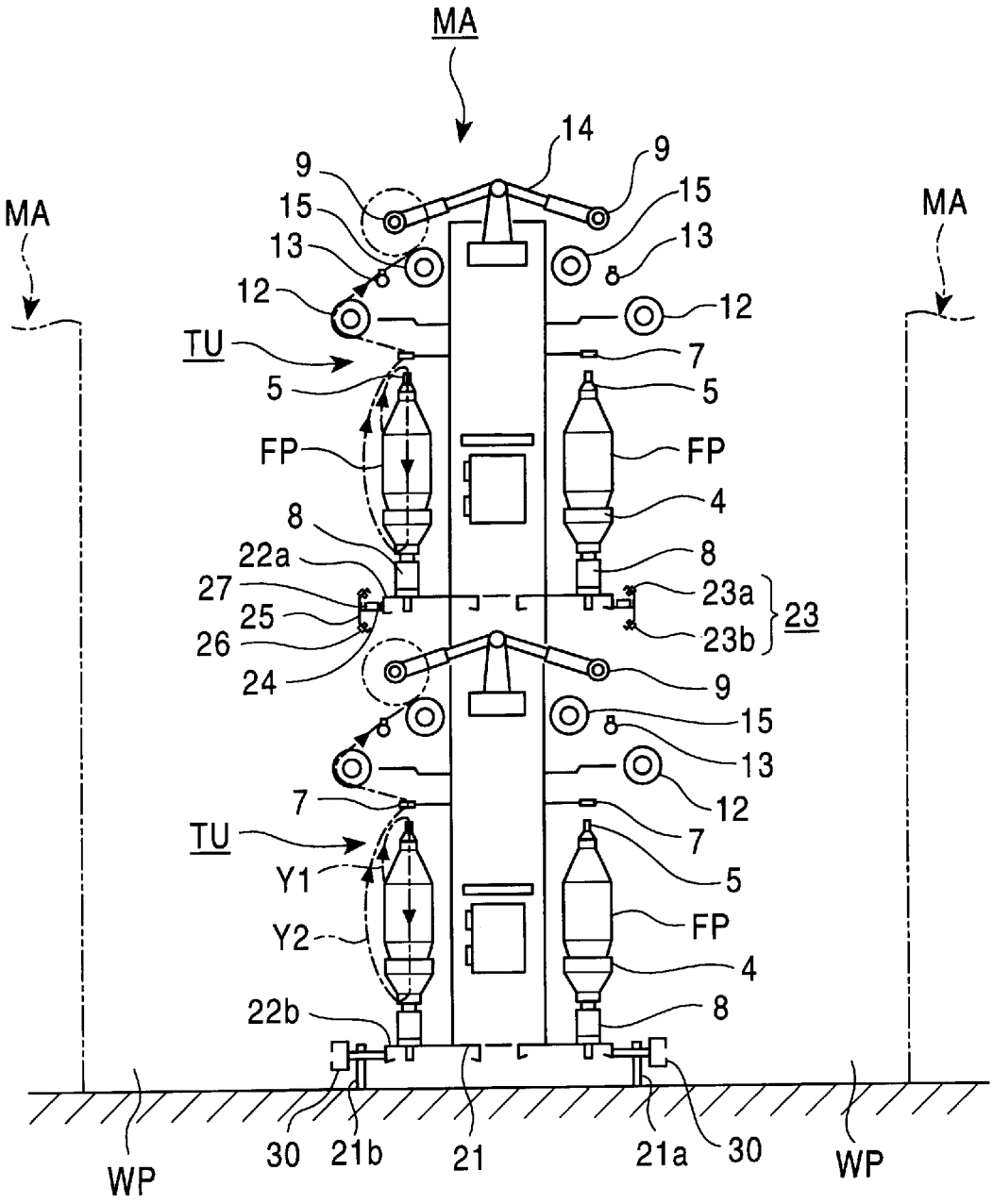
FIG. 2 is a schematic front view showing an embodiment of a two-stage type twister MA that is configured to be installed twisting units having filament yarn supply package FP in upper and lower stages on both surfaces of the machine body.
Figure 3:
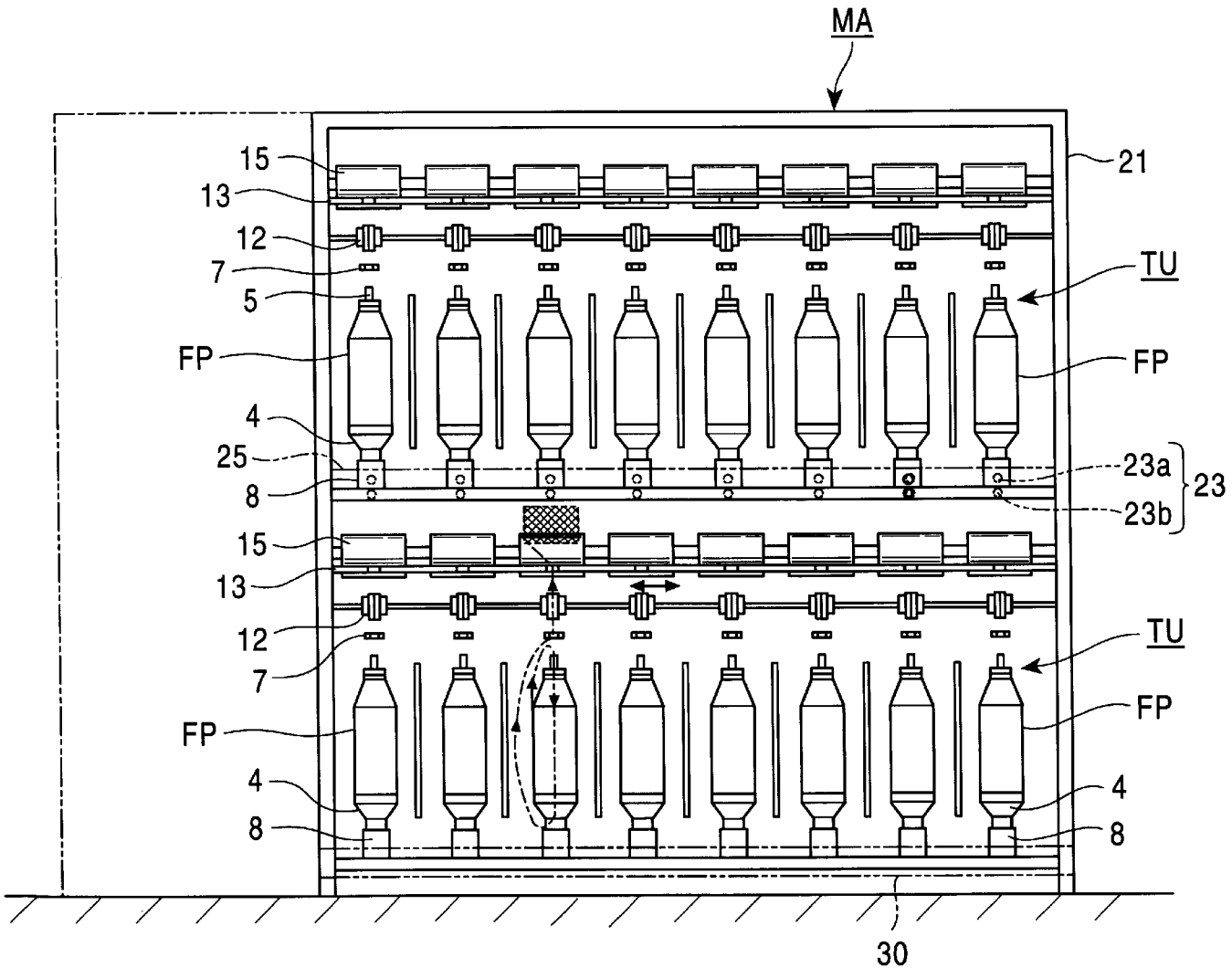
FIG. 3 is a schematic side view showing the two-stage type twister MA in FIG. 2 as seen from one side.
Figure 4:
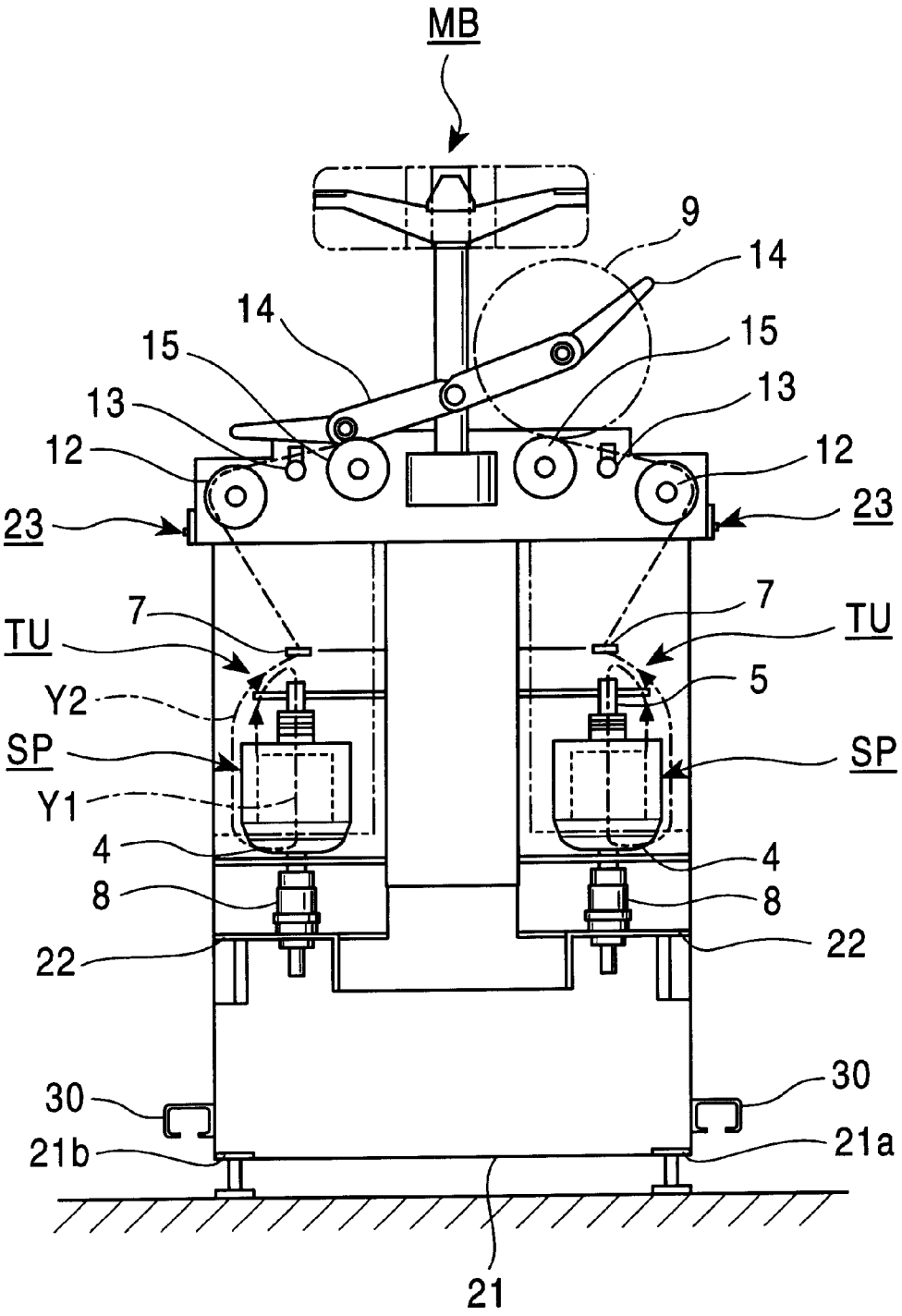
FIG. 4 is a schematic front view showing an embodiment of a one-stage type twister MB that is configured to be installed twisting units having spun yarn supply package SP in one stage on both surfaces of the machine body.
Figure 5:
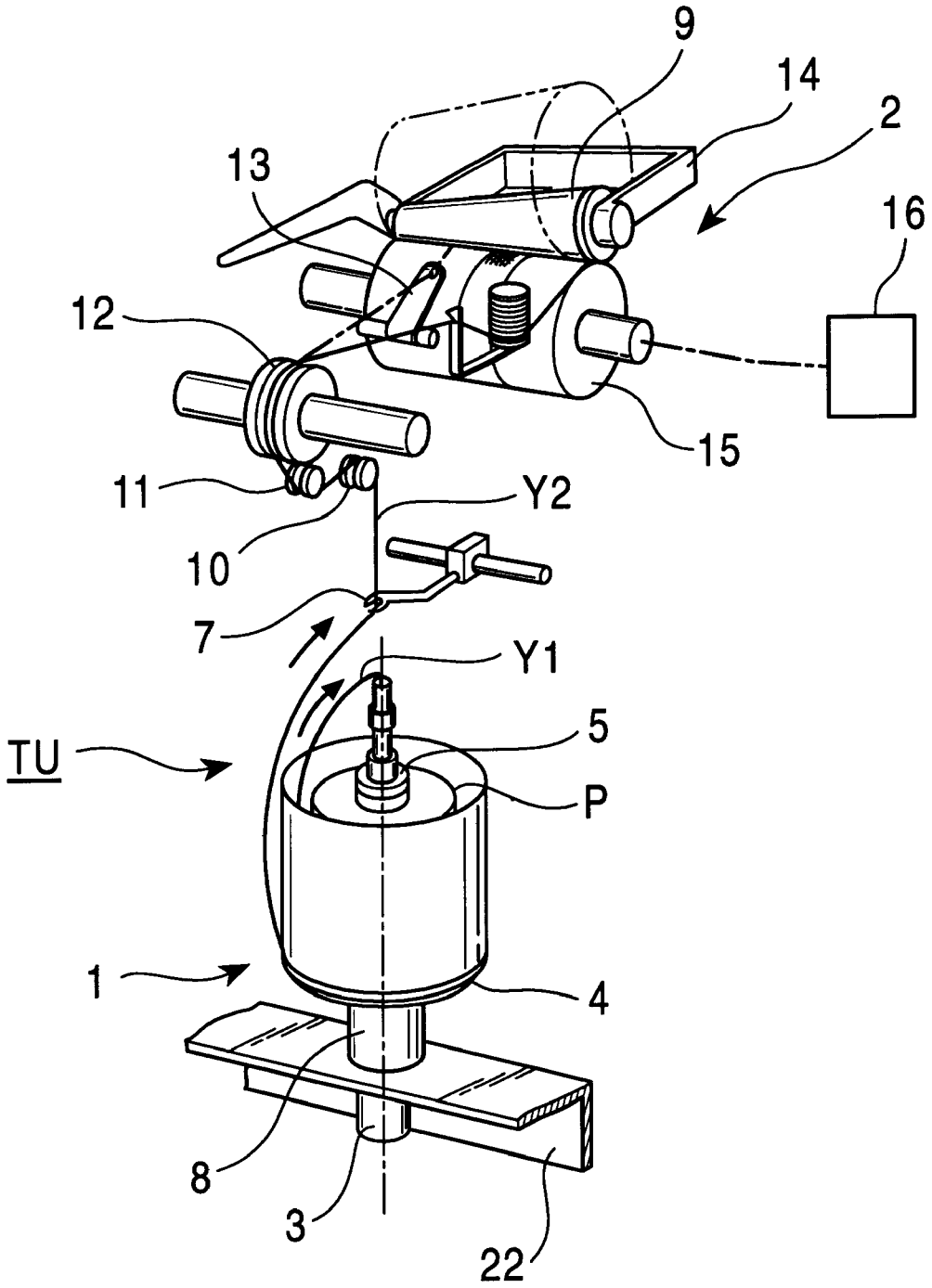
FIG. 5 shows a specific configuration of a single twisting unit TU in an individual-spindle-drive type multiple twister.

FIG. 2 is a schematic front view showing an embodiment of a two-stage type twister MA that is configured to have the twisting units having the filament yarn supply packages FP disposed in upper and lower stages on both surfaces of the machine body. FIG. 3 is a schematic side view showing the two-stage type twister MA in FIG. 2 as seen from one side. FIG. 4 is a schematic front view showing an embodiment of a one-stage type twister MB that is configured to have the twisting units having the spun yarn supply packages SP disposed in one stage on both surfaces of the machine body.

First, the basic structure of the two-stage type twister MA to which the present invention is applied will be described with reference to FIGS. 2 and 3. In the two-stage type twister MA, twisting units TU having the filament yarn supply packages FP are arranged in a line and in upper and lower stages on both surfaces 21*a* and 21*b* of a machine body 21.

The twisting units TU are mounted on a spindle rail 22, and the upper stage twisting units TU are arranged on an upper stage spindle rail 22*a* at a predetermined interval, while the lower stage twisting units TU are arranged on a lower stage spindle rail 22*b* at a predetermined interval.

According to the present invention, a switching means 23 corresponding to the spindle drive source 8 for each spindle is provided to drive and stop the spindle drive source 8 for each spindle. In the case of the two-stage type twister MA shown in FIGS. 2 and 3, the switching means 23 are mounted on the upper stage spindle rail 22*a* at the same or approximately the same height relative to the machine body 21 via bracket members 24 and switch mounting rails 25 located at an appropriate interval. The switching means 23 is connected to a motor driving apparatus (not shown in the drawings) located between a two rows of twisting units TU that are disposed back to back.

A specific embodiment for mounting the switching means 23 on the machine body will be described with reference to FIGS. 1A and 1B.

According to the configuration of the first example shown in FIG. 1A, the switching means 23 is mounted on the upper stage spindle rail 22*a* via the switch mounting rail 25, which has a bracket member 24 and a switch mounting surface 26.

The switch mounting rail 25 according to the first example is used for both the upper and lower stages and has a switch mounting surface 26*a* on which an upper stage switch 23*a* is mounted and a switch mounting surface 26*b* on which a lower stage switch 23*b* is mounted. The switch mounting surfaces 26*a* and 26*b* of the switch mounting rail 25 according to the first example are formed of inclined surfaces that incline toward the machine body 21. A vertical section of the switch mounting rail 25 between both inclined surfaces constitutes a switch protection section that protrudes forward from the switch mounting surface 26*a*.

Furthermore, according to the switch mounting of the first example, a wiring terminal block 27 can be incorporated in the bracket member 24.

On the other hand, according to the configuration of a second example shown in FIG. 1B, the switching means 23 is mounted on the upper stage spindle rail 22*a* via the switch mounting rail 25, which has the bracket member 24 and the switch mounting surface 26.

The switch mounting rail 25 according to the second example is also used for both the upper and lower stages and has a switch mounting surface 26 on which the upper stage switch 23*a* and the lower stage switches 23*b* are mounted close to each other. The switch mounting rail 25 according to the second example has a switch protection section 28 that protrudes forward from the switch mounting surface 26, and the switch protection section 28 is formed by at least an open space 29 in front of the switch. In the first and second examples, the switch protection section 28 can prevent the operator from inadvertently touching the switching means 23.

In either of the above embodiments, the switching means 23 is located rearward from the front end of the both surfaces 21*a* and 21*b* of the machine body 21, and the illustrated embodiments are each configured so that the machine body front end forming member 30 is attached to the bottom of both surfaces 21*a* and 21*b* of the machine body 21 in such a way as to protrude toward the working passage side. This configuration can reliably prevent the operator from inadvertently touching the switching means 23.

Furthermore, in either of the above embodiments, each switching means 23 includes a lighting means that is configured to light while the twisting unit TU is stopped, and the lighting means enables the operator to view the stopped twisting units TU from the front of the machine body.

On the other hand, the basic structure of a one-stage type twister MB to which the present invention is applied will be described with reference to FIG. 4.

The one-stage type multiple twister MB comprises a larger number of twisting units TU, having spun yarn supply packages SP, installed in a line on both surfaces 21*a* and 21*b* of the machine body 21.

The twisting units TU for the respective spindles are installed on the spindle rail 22 in a line at a predetermined interval.

According to the present invention, the switching means 23 corresponding to the spindle drive source 8 for each spindle is provided to drive and stop the spindle drive source 8 for each spindle. In the case of the one-stage type twister MB shown in FIG. 4, the switching means 23 is mounted at the same or approximately the same height as the upper section of the machine body 21.

In either of the above embodiments, the switching means 23 is also located rearward from the front end of the both surfaces 21*a* and 21*b* of the machine body 21, and the illustrated embodiment is configured so that the machine body front end forming member 30 is attached to the bottom of both surfaces 21*a* and 21*b* of the machine body 21 in such a way as to protrude toward the working passage side.

Furthermore, in this embodiment, each switching means 23 includes a lighting means that is configured to light while the twisting units TU is stopped. This lighting means enables the operator to view the stopped twisting unit TU from the front of the machine body 21.

According to the individual-spindle-drive type multiple twister according to the present invention configured as described above, the spindle can be driven and stopped for each twisting unit TU, and even given the large number of switches along the machine body, the drive conditions of the spindles can be checked visually and promptly based on the lighting conditions of the switches. In particular, even if a certain spindle is stopped due to a malfunction in the spindle motor or its drive circuit, its spindle position can be promptly identified so as to take required action.

Furthermore, according to the individual-spindle-drive type multiple twister of the present invention, the switch mounting rail is mounted on the spindle rail using brackets located at an appropriate interval, so a wiring terminal block can be provided on the bracket to join together wires from a plurality of switches in order to facilitate wiring and maintenance (mounting and removal).

Moreover, according to the individual-spindle-drive type multiple twister of the present invention, the inclined sections are formed on both upper and lower sides of the mounting rail, and the switches for the upper and lower side respectively are provided on the inclined sections in such a way as to protrude therefrom. Consequently, a switch can be simply operated. This configuration is effective during yarn threading operations. In threading operations, yarn that has been passed through the spindle is drawn up and passed through the guide roller and feed roller, a small length of the yarn is subsequently wound around a bobbin held on the cradle, and the switch is then turned on with a predetermined timing to start winding (The cradle is lowered to contact the take-up tube with the winding drum).

Next, a drive chamber and a control chamber for a drum and a traverse apparatus which are provided on one side of the machine body in the individual-spindle-drive type multiple twister will be described below.

Figure 7A:
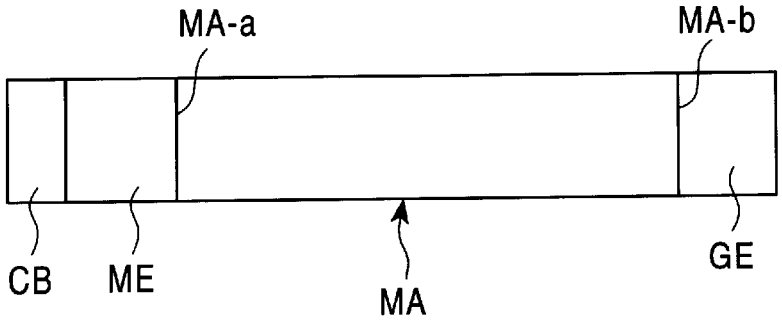
FIG. 7A is a schematic plane view showing an example of a filament yarn apparatus.

In a conventional simultaneous drive type multiple twister, in the case of an apparatus for a filament yarn such as that shown in FIG. 7A, a motor end ME and a control box CB are connected to one side MA-a of the machine body MA, and a gear end GE that performs a change pulley operation (changing the count of twist to change the ratio between the rotation speed of the rotating disc and the rotation speed of the winding drum) is connected to the other side MA-b of the machine body MA.

Figure 7B:
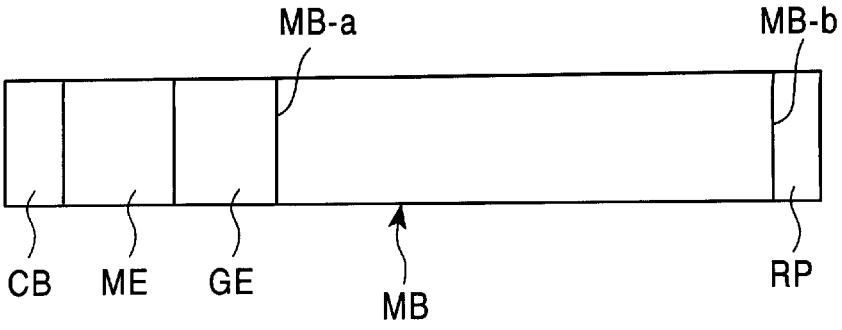
FIG. 7B is a schematic plane view showing an example of a spun yarn apparatus.

On the other hand, in the case of an apparatus for a spun yarn such as that shown in FIG. 7B, the gear end GE, the motor end ME, and the control box CB are connected to one side MB-a of a machine body MB, and a return pulley RP used to install a tangential belt for simultaneously driving the spindles is connected to the other side MB-b of the machine body MB. In this case, the motor for driving both the tangential belt and the winding apparatus occupies most of the inside of the motor end ME, and the motor for adjusting the tension of the belt may move and requires space for its movement.

As described above, in both the apparatuses for the filament yarn and the spun yarn, the conventional simultaneous drive type multiple twister requires a space in the longitudinal direction of each machine body as shown in FIG. 7A and 7B.

Thus, the present invention attempts to solve this problem of the conventional simultaneous drive type multiple twister. An object of the present invention is thus to provide an individual-spindle-drive type multiple twister that includes a drive motor for each spindle, wherein the drive chamber and control chamber are compact and concentrated on one side of the machine body so as to enable various change operations to be performed easily. To achieve this object, the present invention provides an individual-spindle-drive type multiple twister that includes a spindle drive motor for each spindle and that drives a winding drum and a traverse using a common winding system motor, wherein:

a winding system drive chamber is provided on one side of a machine body, wherein the winding system drive chamber is partitioned into a first chamber that accommodates a traverse mechanism section for transforming the rotational drive transmitted from a winding drum shaft into the reciprocating motion of a traverse guide, and a second chamber that accommodates the winding system motor in which is provided a transmission means for transmitting the rotational drive of the winding drum shaft to the traverse mechanism section.

Furthermore, the present invention provides an individual-spindle-drive type multiple twister wherein the transmission means is provided at a position at which it does not appear to overlap the winding system motor as seen from the direction in which the first and second chambers appear to overlap each other.

Moreover, the present invention provides an individual-spindle-drive type multiple twister wherein the second chamber includes a speed reducer for reducing the speed of the rotational drive of the winding system motor and a transmission means for transmitting the rotational drive of the output shaft of the speed reducer to the winding drum shaft.

An individual-spindle-drive type multiple twister according to the present invention will be described below in detail based on the specific embodiments shown in the drawings.

Figure 6:
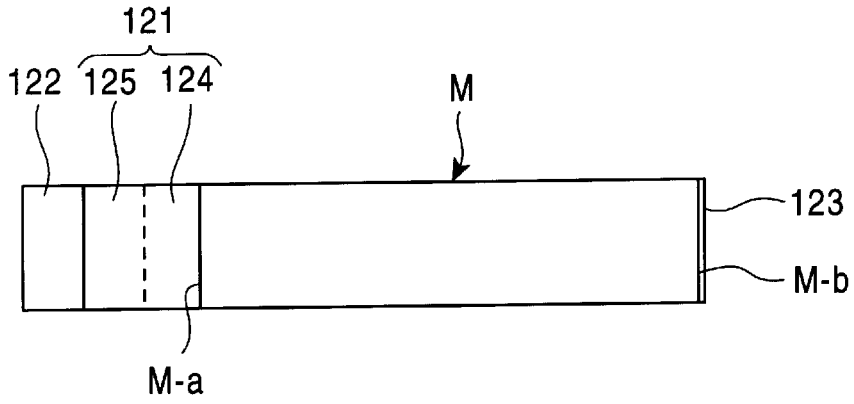
FIG. 6 is a schematic plane view showing an example of a basic configuration of the individual-spindle-drive type multiple twister according to the present invention.

FIG. 6 is a schematic plane view showing an example of a basic configuration of the individual-spindle-drive type multiple twister according to the present invention. FIG. 7 shows an example of a configuration of a conventional simultaneous drive type multiple twister, FIG. 7A is a schematic plane view showing an example of an apparatus for a filament yarn, and FIG. 7B is a schematic plane view showing an example of an apparatus for a spun yarn.

Figure 8:
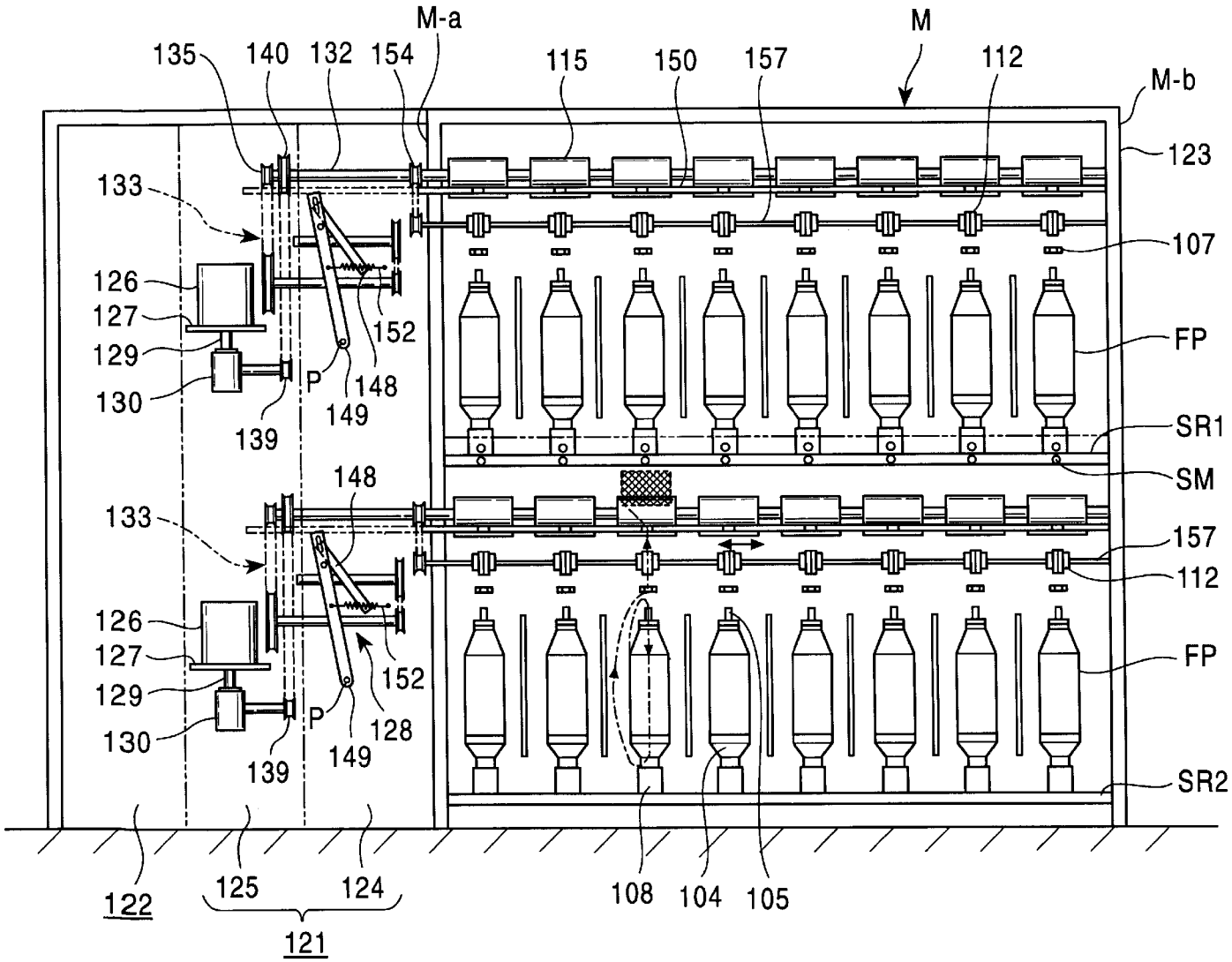
FIG. 8 is a schematic front view showing the details of a specific configuration example that is applied to an individual-spindle-drive type multiple twister with upper and lower stages including filament yarn supply package FP according to the present invention.
Figure 9:
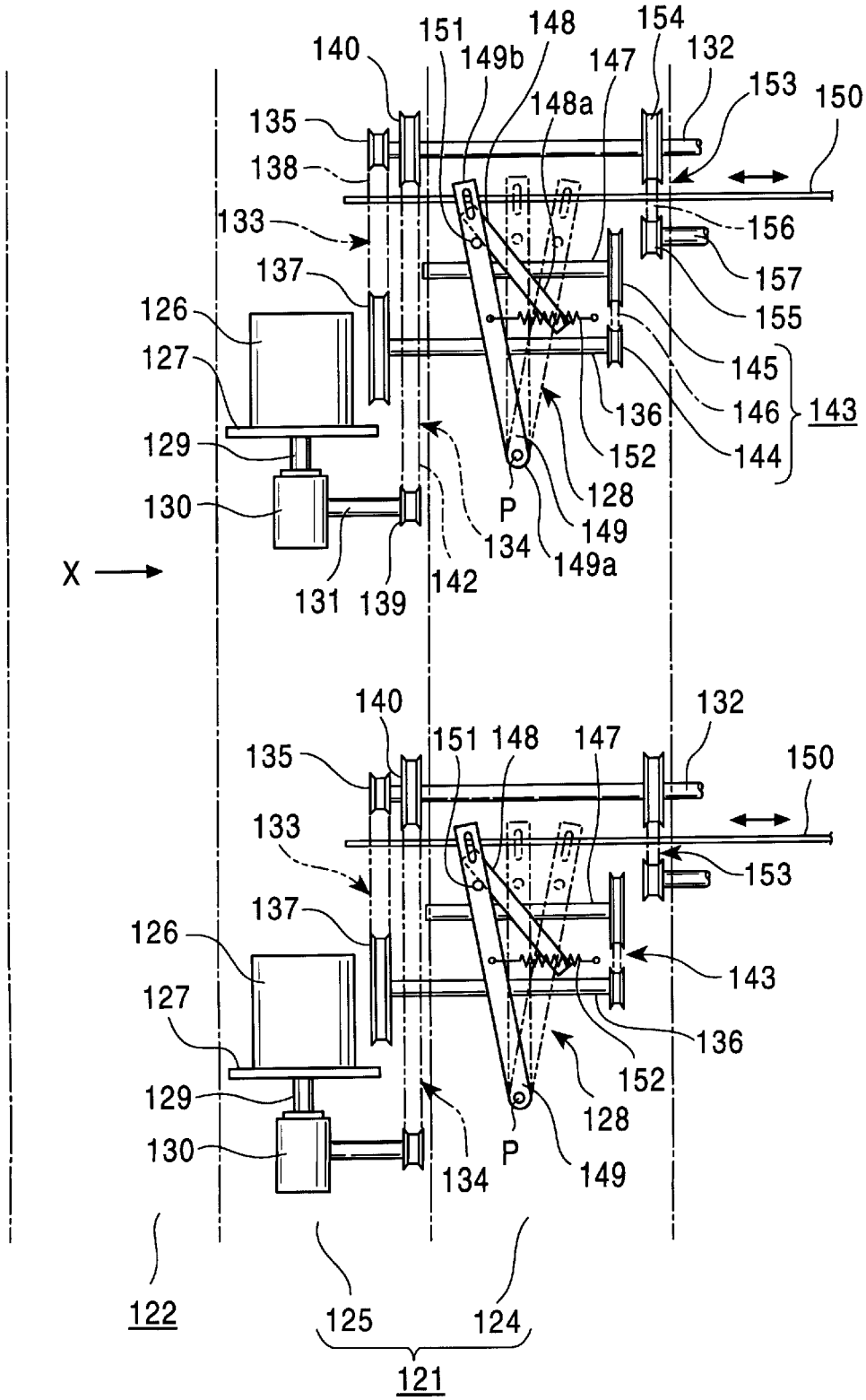
FIG. 9 is a schematic front view showing the details of a specific embodiment of a winding system driving mechanism according to the configuration example shown in FIG. 8.
Figure 10:
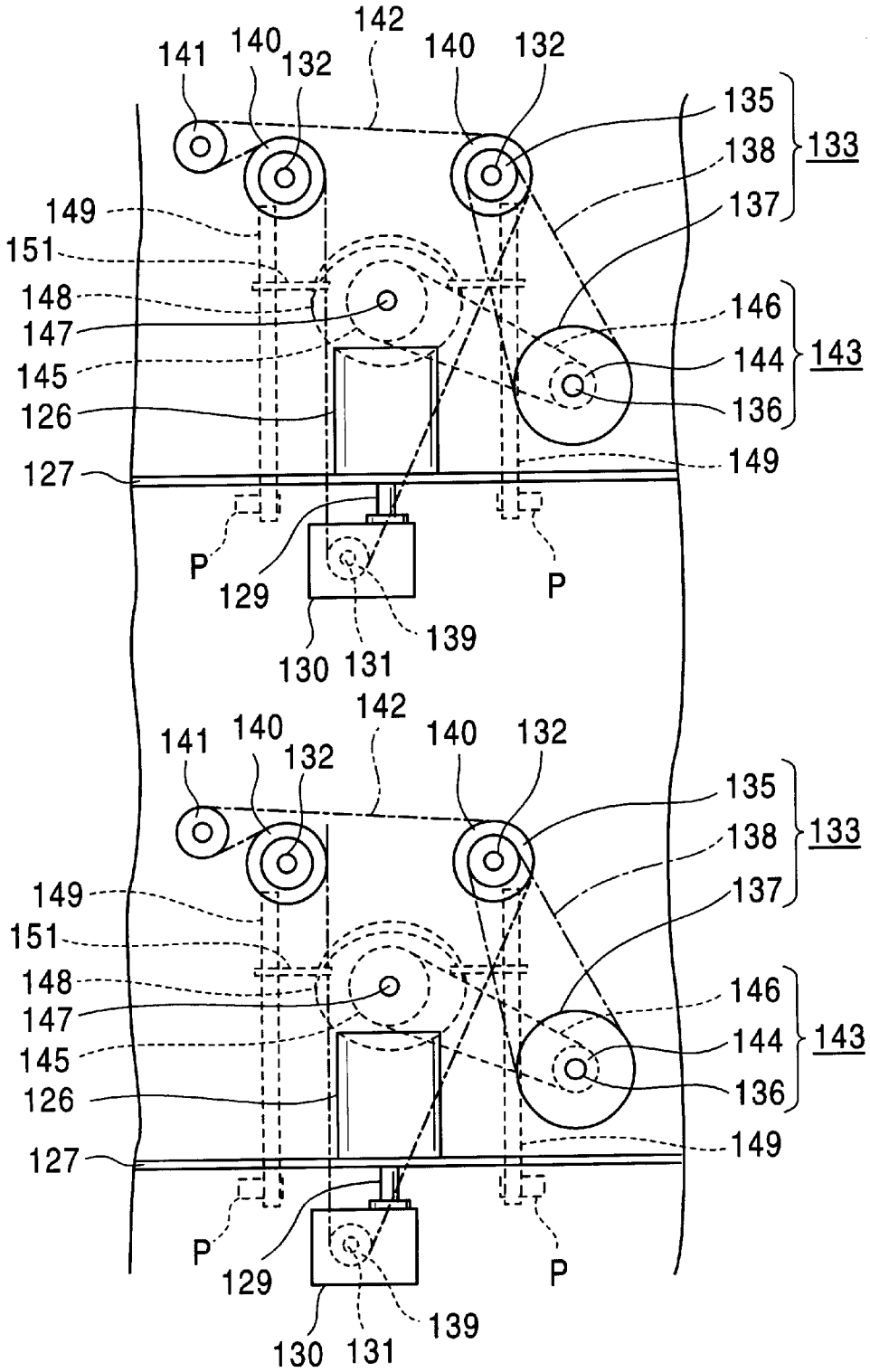
FIG. 10 is a schematic side view as seen from the direction of arrow X shown in FIG. 9.

FIG. 8 is a schematic front view that shows the details of an example of specific configuration that is applied to an individual-spindle-drive type multiple twister with upper and lower stages according to the present invention. FIG. 9 is a schematic front view showing the details of a specific embodiment of a winding system driving mechanism according to the configuration example shown in FIG. 8, and FIG. 10 is a schematic side view as seen from the direction of arrow X shown in FIG. 9.

As shown in FIG. 6, in the individual-spindle-drive type multiple twister according to the present invention, a winding system drive chamber 121 is provided on one side M-a of a machine body M, and a control box 122 is coupled to the winding system drive chamber 121. The other side M-b of the machine body M is composed of only a machine body cover 123. According to the present invention, the winding system drive chamber 121 is partitioned midway using a partitioning plate, and the drive chamber 121 therfore consists of a first chamber 124 and a second chamber 125 located across the partitioning plate. The partitioning plate supports a plurality of shafts, including such as a winding drum shaft 132 which is described below, a drive shaft 136, and a cam operating shaft 147 in such a way as to protrude from the first chamber 124 toward the second chamber 125. In other words, the partitioning plate acts as a supporting member for supporting a plurality of drive transmission shafts (the winding drum shaft 132, the drive shaft 136, the cam operating shaft 147, and so on) that transmit the drive of a winding system motor 126 to each section. The partitioning plate defines the first chamber 124 and the second chamber 125, but the sizes of the spaces in both chambers as determined by the position of partitioning plate are not particularly limited in any way.

Next, the configuration of the winding system drive chamber 121 will be described in detail with reference to FIGS. 9 and 10.

As shown in FIG. 9, the winding system drive chamber 126 is accommodated in the second chamber 125 of the winding system drive chamber 121 in such a way as to be fixed to a frame 127, and a traverse mechanism section 128 is accommodated in the first chamber 124 of the winding system drive chamber 121. A speed reducer 130 comprising an output shaft 131 is connected to the output shaft 129 side of the winding system motor 126.

The second chamber 125 of the winding system drive chamber 121 accommodates a first transmission means 133 for transmitting the rotational drive transmitted from a winding drum shaft 132 that extends to a winding drum 115 in the machine body M to the traverse mechanism section 128, and a second transmission means 134 for transmitting the rotational drive of the output shaft 131 of the speed reducer 130 to the winding drum shaft 132.

The first transmission means 133 comprises a pulley 135 provided on the winding drum shaft 132, a pulley 137 provided on the drive shaft 136 of the traverse mechanism section 128, and a belt 138 that runs between the pulley 135 and the pulley 137. The second transmission means 134 comprises a pulley 139 provided on the output shaft 131 of the speed reducer 130, pulleys 140, 140 provided on the winding drum shafts 132, 132, an adjustment pulley 141, and a belt 142 that runs between these pulleys.

According to the present invention, the first transmission means 133 is assembled at a position where it does not appear to overlap the winding system motor 126 as seen from the direction (the arrow X direction in FIG. 9) in which the first chamber 124 and the second chamber 125 appear to overlap each other.

Next, a specific configuration of the traverse mechanism section 128 accommodated in the first chamber 124 of the winding system drive chamber 121 will be described. The traverse mechanism section 128 includes a cam member 148 mounted on a cam operation shaft 147 that is rotationally driven relative to the drive shaft 136 by a third transmission means 143, which comprises pulleys 144 and 145 and a belt 146. The cam member 148 is a disc-shaped cam that is fixed to the cam operation shaft 147 in such a way as to incline relative to the axis of the shaft 147.

Furthermore, the traverse mechanism section 128 includes an oscillating lever member 149 that is oscillated by the rotational drive of the cam member 148. The oscillating lever member 149 is pivotably supported on the frame 127 by a pivotal shaft P provided at one end 149*a*, and its other end 149*b* is connected to a traverse guide 150. The oscillating lever 149 comprises an engaging piece 151 that engages a surface 148*a* of the cam member 148 and that comprises a spring 152 that urges the oscillating lever member 149 in the direction in which it is pulled. The pair of oscillating lever members 149, 149 on both sides engage the single cam member 148, and the springs 152, 152 are connected to the pair of oscillating lever members 149, 149, respectively. One end of each of the pair of springs 152, 152 is connected to a common chain (not shown in the drawing) so that the pair of oscillating lever members 149, 149 oscillate concurrently.

The traverse mechanism section 128 configured as described above transforms the rotational drive transmitted from the winding drum shaft 132 into the reciprocating motion of the traverse guide 150. That is, the rotational drive of the winding drum shaft 132 is transmitted to the cam member 148 via the first transmission means 133 and the third transmission means 143 to rotate the cam member 148 and oscillate the oscillating lever member 149 engaged with the cam member 148, thereby enabling the traverse guide 150 connected to the operation end side of the oscillating lever member 149 to be reciprocated in the lateral direction shown by the arrow in FIG. 9.

Furthermore, a fourth transmission means 153 comprising pulleys 154 and 155 and a belt 156 transmits the rotational drive of the winding drum shaft 132 to a feed roller shaft 157.

The basic structure of a two-stage type twister MA to which the present invention is applied will be described with reference to FIG. 8.

The two-stage type twister MA comprises a large number of twisting units TU including filament yarn supply pages FP installed in a line on both surfaces of the machine body. The twisting unit TU for each spindle is mounted on a spindle rail SR, and the upper stage twisting units TU are arranged on an upper stage spindle rail SR1 at a predetermined interval, while the lower stage twisting units TU are arranged on a lower stage spindle rail SR2 at a predetermined interval.

According to this embodiment, a switching means SM corresponding to a spindle drive source 108 for each spindle is provided to drive and stop the spindle drive source for each spindle. In the case of the two-stage type twister MA shown in FIG. 8, the switching means SM are mounted on the upper stage spindle rail SR1 at the same or approximately the same height relative to the machine body 21 via bracket members and switch mounting rails located at an appropriate interval.

Each switching means SM includes a lighting means that is configured to light while the twisting units TU is stopped, thereby enabling the operator to view the stopped twisting unit TU from the front of the machine body.

According to this embodiment, the first transmission means 133 and the second transmission means 134, which sometimes require various adjustments and modifications, are located closer to the winding system motor 126 than the supporting section for the driving transmission shaft, which is located midway inside the winding system drive chamber 121. Consequently, the transmission means can be adjusted or changed using the space (second chamber 125) on the winding system motor 126 side defined by the supporting section.

According to the individual-spindle-drive type multiple twister configured as described above, because each spindle is driven separately, the winding system drive motor may be small. Consequently, the winding system drive motor is located in the second chamber in which the traverse mechanism section is not provided, and the first transmission means for this motor is also located in the second chamber. As a result, the space in the second chamber can be used to adjust the first transmission means in order to change the traverse angle.

According to the individual-spindle-drive type multiple twister of the present invention, the first transmission means is configured so as not to appear to overlap the winding system motor as seen from the direction in which the first and second chamber appear to overlap each other. Thus, the drive chamber can be compact, enabling the traverse angle change operation to be performed more easily.

Furthermore, according to the individual-spindle-drive type multiple twister of the present invention, the space in the second chamber can be used to adjust the second transmission means in order to change the number of twists imparted to the yarn more easily.

What is claimed is:

1. An individual-spindle-drive type multiple twister comprising a large number of twisting units installed on a machine body in a line which twist yarn unwound from a supply package by rotation of a spindle, and provided with a spindle drive source for each spindle, characterized in that:

a switching means corresponding to the spindle drive source for each spindle is provided to drive and stop the spindle drive source for each spindle;

each switching means for each spindle being located rearward from a front end of the machine body, so as to prevent an operator from inadvertently touching the switching means.

2. An individual-spindle-drive type multiple twister as in claim 1 characterized in that all the spindle switching means corresponding to said large number of twisting units installed in a line are mounted on a switch mounting rail having a switch mounting surface, and are arranged at substantially the same height relative to the machine body.

3. An individual-spindle-drive type multiple twister as in claim 1 or 2, characterized in that a switch mounting rail is provided and said switch mounting rail is mounted on the machine body via bracket members, and a wiring terminal block is provided on the bracket member.

4. An individual-spindle-drive type multiple twister as in claim 1 or 2, characterized in that a switch mounting rail is provided, having a switch mounting surface, and the switching means for each spindle protrudes from the switch mounting surface of said switch mounting rail.

5. An individual-spindle-drive type multiple twister as in claim 1 or claim 2 characterized in that the switching means for each spindle is located rearward from the front end of the machine body.

6. An individual-spindle-drive type multiple twister as in claim 1 or claim 2 characterized in that the switching means for each spindle includes a lighting means that lights while the twisting unit is stopped.

7. An individual-spindle-drive type multiple twister comprising a large number of twisting units installed on a machine body in a line which twist yarn unwound from a supply package by rotation of a spindle, and provided with a spindle drive source for each spindle, characterized in that:

a switching means corresponding to the spindle drive source for each spindle is provided to drive and stop the spindle drive source for each spindle; and said twisting units are arranged in upper and lower stages, a switch mounting rail commonly used for the upper and lower stages is provided along the machine body, and switching means for the upper and lower stages are provided close to one another on said switch mounting rail.

8. An individual-spindle-drive type multiple twister as in claim 7, characterized in that all the spindle switching means corresponding to said large number of twisting units installed in a line are mounted on a switch mounting rail having a switch mounting surface, and are arranged at substantially the same height relative to the machine body.

9. An individual-spindle-drive type multiple twister comprising a large number of twisting units installed on a machine body in a line which twist yarn unwound from a supply package by rotation of a spindle, and provided with a spindle drive source for each spindle, characterized in that:

a switching means corresponding to the spindle drive source for each spindle is provided to drive and stop the spindle drive source for each spindle;

said twisting units are arranged in upper and lower stages;

a switch mounting rail commonly used for the supper and lower stages is provided along the machine body; and a switch mounting surface of said switch mounting rail inclines toward the machine body.

10. An individual-spindle-drive type multiple twister as in claim 9, characterized in that all the spindle switching means corresponding to said large number of twisting units installed in a line are mounted on a switch mounting rail having a switch mounting surface, and are arranged at the substantially the same height relative to the machine body.

* * * * *